US005450965A

United States Patent [19]

Cox

[11] Patent Number: 5,450,965

[45] Date of Patent: Sep. 19, 1995

[54] STRETCH-WRAP PACKAGED ASSEMBLY

[75] Inventor: Kenneth L. Cox, Muscatine, Iowa

[73] Assignee: Hon Industries, Inc., Muscatine, Iowa

[21] Appl. No.: 174,962

[22] Filed: Dec. 29, 1993

[51] Int. Cl.[6] ..... B65D 19/00

[52] U.S. Cl. ..... 206/597; 206/525; 53/441; 53/556

[58] Field of Search ..... 206/525, 459.5, 600, 206/497, 597; 53/217, 441, 556

[56] References Cited

U.S. PATENT DOCUMENTS

| | | | |
|---|---|---|---|
| 3,944,070 | 3/1976 | Cardwell et al. | 206/497 |
| 3,954,219 | 5/1976 | Mangini et al. | 206/597 |
| 3,986,611 | 10/1976 | Dreher | 53/441 |
| 4,158,410 | 6/1979 | Novatny | 206/597 |
| 4,271,657 | 6/1981 | Lancaster, III et al. | 53/441 |
| 4,603,809 | 8/1986 | Vilotte et al. | 206/459.5 |
| 4,807,427 | 2/1989 | Casteel et al. | 53/441 |
| 4,919,270 | 4/1990 | Govang et al. | 53/399 |
| 5,251,753 | 10/1993 | Pigott et al. | 206/597 |
| 5,271,498 | 12/1993 | Gillespie | 206/497 |
| 5,307,928 | 5/1994 | Bishop | 206/597 |

FOREIGN PATENT DOCUMENTS

| | | | |
|---|---|---|---|
| 2931337 | 2/1981 | Germany | 206/597 |

*Primary Examiner*—David T. Fidei

*Attorney, Agent, or Firm*—Jones, Day, Reavis & Pogue

[57] ABSTRACT

A stretch-wrap packaged assembly comprising a product core and a packing end cap of stiff material on at least one end of the product core wherein the cap has an open end, an end panel section, and a plurality of side flanges extending from the end panel section defining a plurality of side intersections of the end cap extending from the end panel section. Stretched elastic film is wrapped around the product end of the product core such that the film overlaps a first portion of the side flanges leaving a second portion of the side flanges free of coverage by the film and the sleeve having at least one terminal end edge created by a gathered portion of the film for forming a rope section tightly circumscribing and engaging the side flanges of the end cap in spaced relationship to the panel section for securing the end cap to the product core. A related method is also provided.

18 Claims, 2 Drawing Sheets

STRETCH-WRAP PACKAGED ASSEMBLY

BACKGROUND OF THE INVENTION

1. Field of the Invention

The present invention relates generally to packaging and more particularly to an assembly wherein a product core is wrapped in stretched film. In addition, the assembly is of such construction that a portion of the assembly is without plastic film coverage to allow product identification indicia to be placed on the assembly and later read by humans or machines.

2. Description of Related Art

The use of stretch wrapping for assembling shipping packages is wellknown in the art. Whether the package is completely enclosed by a stretched film or has a selected pattern of film around portions of the package, there have been many different attempts to wrap a package for shipment. It is also well-known to form a stretch-wrap film into rope sections and either rope the entire sheet of film or only a portion of the sheet.

For example, a patent to Lancaster, U.S. Pat. No. 5,031,771, discloses a roped stretch-wrapping system. A web of film is roped at both the top and bottom and is wrapped about a plurality of stacked units in order to hold the stack together during shipping. The film is roped and wrapped about the stack of units such that the roped sections hold adjoining units together but is wrapped in such a manner that the film does not cover the entire load. Rather, the film is wrapped in Z-shaped patterns thereby allowing the load to breathe by permitting airflow through the wrapped units. Lancaster does not teach forming a binding sleeve to enclose the product core in stretch-wrap film; but is instead focused on allowing the bound units to be exposed to the air.

Another patent issued to Casteel, et al., U.S. Pat. No. 4,807,427, discloses a stretch-wrap roping apparatus. Casteel, et al. disclose completely wrapping a package in stretch-wrap then forming a rope of the entire web of film in order to encircle top and bottom portions of the package with the rope to more securely hold the package together.

It would be desirable to provide a wrapped package wherein a continuous binding sleeve is formed about the package but that still provides an uncovered portion for allowing labels and other indicia to be placed on the package and be easily read.

With the increased use of computers and optical character readers for inventory control in industry, especially in shipping, it is necessary for each package to have a label applied containing some type of readable code that allows an optical character reader or the like to identify the package and the location from where it came or to where it is going. The stretch-wrap enclosing these packages can significantly affect or prevent an optical character reader or, even a human from reading any labels attached to the package underneath the film. This may prevent a shipper or business from maintaining tight inventory control on a product being sent out once it is wrapped. Therefore, it would be highly desirable to provide a stretch-wrap packaged assembly that provides for a space on the package where an identifying label can be placed such that the stretch-wrap does not interfere or in any way cover up the label. It would also be desirable to provide a package assembly that totally encloses a product to be shipped and thereby protects the product from damage during shipment but still allows for the identifying label to be placed on the package so that the stretch-wrap does not cover the label.

SUMMARY OF THE INVENTION

It is therefore an object of the present invention to provide a stretch-wrap packaged assembly that completely encloses and protects a product during shipping.

It is another object of the invention to provide an assembly wherein the stretch-wrap forms a continuous binding sleeve about a predetermined portion of the assembly wherein a top and bottom portion of the assembly is roped for securely binding the sleeve to the assembly.

It is still another object of the present invention to provide an assembly wherein the stretch-wrap sleeve covers only a predetermined portion of the assembly such that a label can be attached to an uncovered portion of the assembly for allowing easy readability of the label by a person or machine.

Thus, the present invention provides a stretch-wrap packaged assembly comprising a product core having at least a first end cap of stiff material placed on one end of the product core. The end cap has an open end, an end panel section and a plurality of side flanges extending from the end panel section defining a plurality of side intersections of the end cap extending from the panel section. Stretched elastic film is wrapped around the product core forming a binding sleeve extending between the end cap of the opposite end of the product core such that the film overlaps a first portion of the side flanges leaving a second portion of the side flanges free of coverage by the film. The sleeve has at least one terminal end edge created by a gathered portion of the film for forming a rope section tightly circumscribing and engaging the side flanges of the end cap in spaced relation to the panel section for securing the end cap to the product core.

BRIEF DESCRIPTION OF THE DRAWINGS

These and other features of the present invention will be more fully disclosed in the following detailed description of the drawings in which like numerals represent like elements and in which.

DESCRIPTION OF THE PREFERRED EMBODIMENT

Figure 1:
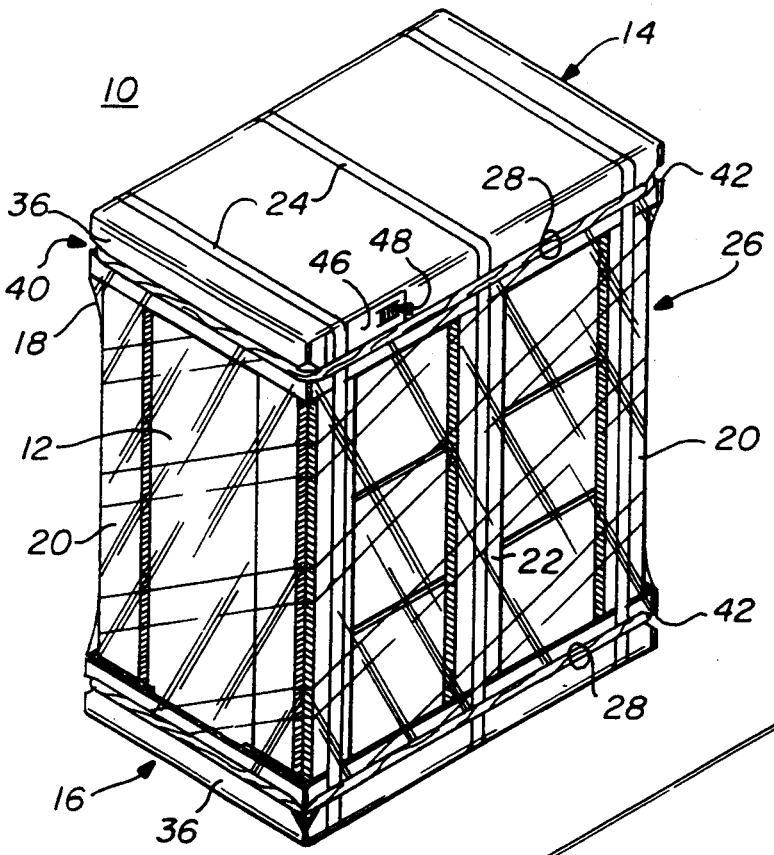
FIG. 1 is a perspective view of a package assembly in accordance with the present invention.

FIG. 1 discloses a stretch-wrap packaged assembly 10, in accordance with the present invention. Assembly 10 includes the product core 12, a top end cap 14, bottom end cap 16, and stretch-wrap 18. In addition, assembly 10 may include corner pads 20, side pads 22, and binding straps 24.

As seen in FIG. 1 stretch-wrap 18 is preferably formed into a continuous binding sleeve 26 that covers the product core and pads 20 and 22. It can also be seen that a rope section 28 is formed at the top and bottom of sleeve 26 such that end caps 14 and 16 are tightly circumscribed and engaged by rope section 28 of binding sleeve 26.

Figure 2:
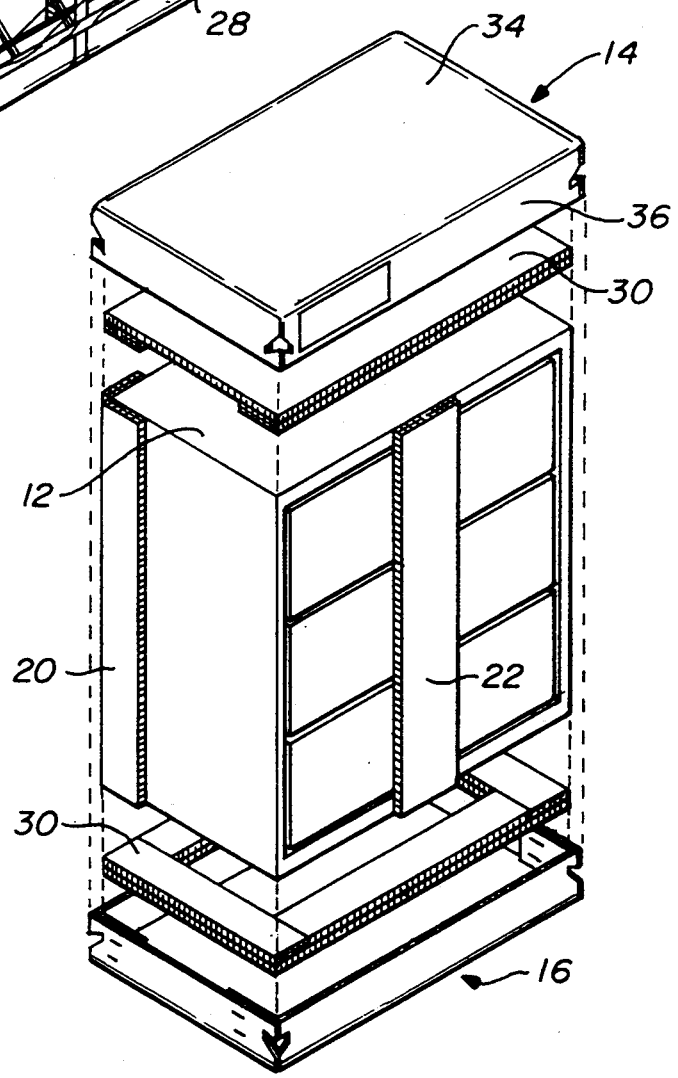
FIG. 2 is an exploded perspective view of the components in a package assembly without the stretch-wrap.

FIG. 2 shows an exploded view of the assembly 10 without stretch-wrap 18. As can be seen, there is preferably additional padding 30 contained within end caps 14 and 16. The padding 30 protects the tops and bottoms of the product core 12 during shipping. During assembly, a pad 30 is inserted into end cap 16 and then product core 12, such as the filing cabinet shown, is placed on padding 30. Next, corner pads 20 are placed at each corner of the product core 12 and one or more side pads 22 are also inserted. Another pad 30 is then placed on top of product core 12 and finally the top end cap 14 is placed over pad 30 such that it surrounds both the product core 12 and the pads 20 and 22.

Figure 3:
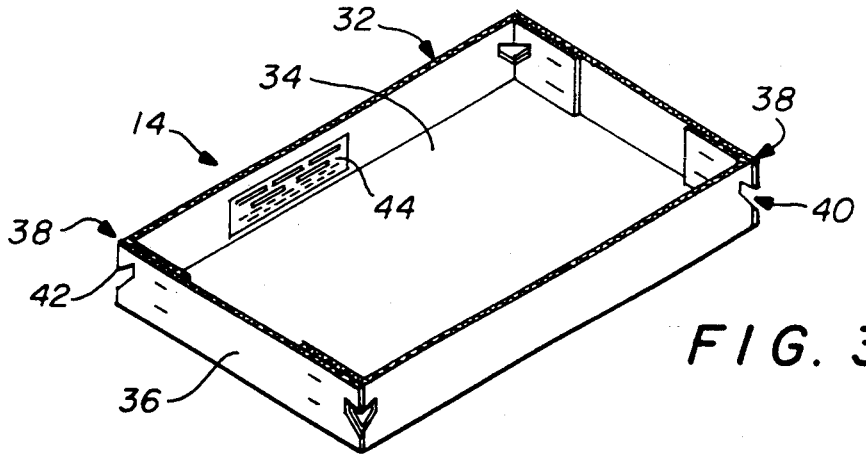
FIG. 3 is a perspective view of the end cap portion of a package assembly in accordance with the present invention.
Figure 4:
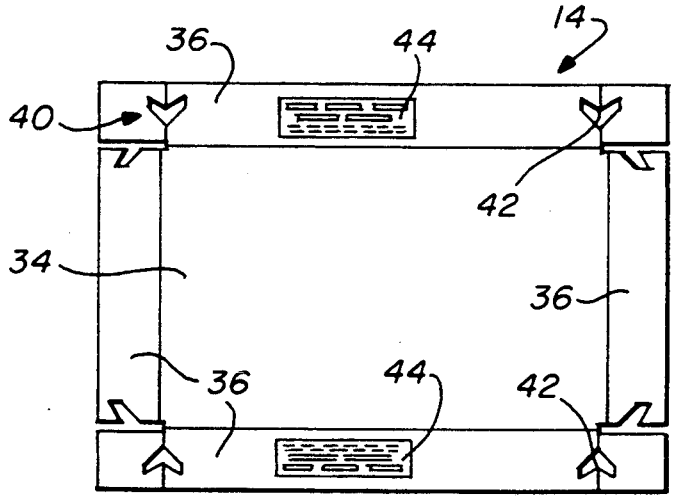
FIG. 4 is an elevational view of the end cap of FIG. 3 wherein the side flanges are folded out flat.

As can best be seen in FIGS. 3 and 4, end cap 14 includes an open end 32, an end panel section 34, and side flanges 36. It is noted that ends caps 14 and 16, as shown, are identical and the discussion with respect to FIGS. 3 and 4 will refer only to end cap 14 but is equally applicable to end cap 16. However, as those skilled in the art will appreciate end caps 14 and 16 could also be of different configurations to accommodate the product core. Side flanges 36 are folded to form a plurality of intersections or corners 38. At each intersection 38 a notch 40 is formed. Preferably, notch 40 is in the shape of a V pointing towards end panel section 34. In this manner, a point 42 is formed that functions to readily accept rope section 28 into notch 40 and also to help grab and bind stretch-wrap 18 to end caps 14 and 16. Notches 40 are preferably formed on side flanges 36 such that a label 44 can be placed on a side flange 36 between notch 40 and end panel section 34.

The provision for allowing a portion of side flanges 36 not to be covered with stretch-wrap 18 and to allow a label 44 to be placed on flange 36 such that it is not covered by stretch-wrap 18 is important. This is because stretch-wrap 18 may not be transparent, as shown in FIG. 1 or, even if it is transparent, when sleeve 26 is formed any labels that are covered up by sleeve 26 can be difficult or impossible to read. This is especially true of machine readable codes such as are read by optical character readers, well known in the art, and used today for inventory control in many warehouses and shipping facilities. The label 46 shown in FIG. 1 contains a bar code 48 that identifies the product core 12. If label 46 were to be covered by sleeve 26, then bar code 48 would possibly not be read by an optical character reader and thus any automated inventory control system set up in a warehouse or by a shipping company would be frustrated. By providing a stretch-wrap packaged assembly 10 wherein sleeve 26 is confined to an area between notches 40 of end caps 14 and 16 an area is provided wherein labels such as 44 or 46 can be placed and inventory control using machine readable codes may be maintained.

Figure 5:
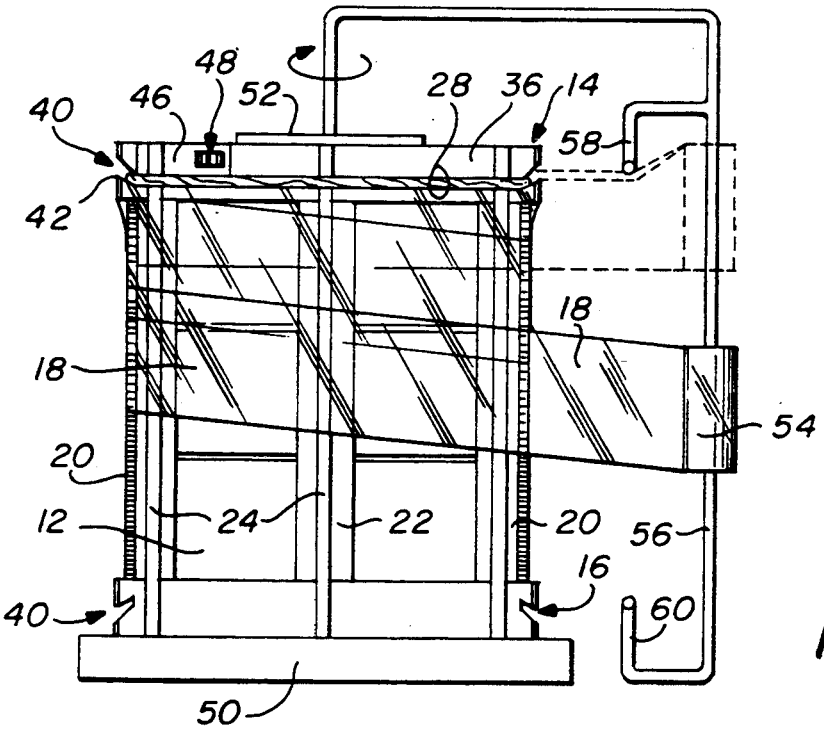
FIG. 5 is a elevational view of a package assembly being wrapped in accordance with the present invention.

FIG. 5 shows assembly 10 being manufactured. Stretch wrapped packaging assembly 10 is preferably put on a rotatable platform 50 and is secured on the top of end cap 14 by a rotatable platen 52 that holds assembly 10 on platform 50 during wrapping. Then when wrapping is begun a roll of stretch-wrap 54 is moved along an axis 56 that is parallel to the length of assembly 10. When roll 54 reaches the top of its travel and edge portion of stretch-wrap 18 contacts a guide bar 58 that functions to gather the upper edge portion of stretch-wrap 18 into rope section 28 by means well known in the art. Guide bar 58 is advantageously aligned at a height that corresponds with notch 40 such that rope section 28 is guided into notch 40 of end cap 14 to enable stretch-wrap 18 to overlap a first portion of flanges 36 and leave a second portion free of coverage by stretch-wrap 18. After a predetermined number of rotations of assembly 10, roll 54 is then moved downwardly along axis 56 such that sleeve 26 is formed. Once roll 54 reaches the bottommost portion of its travel another guide bar 60 contacts the bottom edge portion of stretch-wrap 18 to forming another rope section 28 and guide rope section 28 into notches 40 in the bottom end cap 16. After the appropriate number of rotations of assembly 10, the stretch-wrap 18 is then cut (not shown) from roll 54 and assembly 10 is ready for shipping.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. A stretch-wrap packaged assembly comprising:

a product core having opposite ends;

a first packing end cap of stiff material on at least one end of the product core;

the end cap having an open end, and end panel section, and a plurality of side flanges extending from the end panel section thereby defining a plurality of side intersections of the end cap extending from the end panel section;

stretched elastic film wrapped around the product core forming a binding sleeve extending from the end cap to the opposite end portion of the product core such that the film overlaps a first portion of the side flanges leaving a second portion of the side flanges free of coverage by the film; and the sleeve having at least one terminal end edge created by a gathered portion of the film for forming a rope section tightly circumscribing and engaging the side flanges of the end cap in spaced relation to the panel section thereof for securing the end cap to the product core, the rope section being spaced inwardly of said product core from the horizontal centerline of said end cap such that the second portion of the side flanges is substantially free of coverage by the rope section.

2. The assembly of claim 1 further including readable indicia on the second portion of at least one of the side flanges.

3. The assembly of claim 2 wherein the indicia is a machine-readable code.

4. The assembly of claim 3 wherein the indicia is optically readable.

5. The assembly of claim 2 further including a label on the second portion of at least one of the side flanges.

6. The assembly of claim 5 wherein the label is imprinted with a machine-readable bar code.

7. The assembly of claim 1 wherein the side flanges present structure defining V-shaped notches in the side intersections for engaging the rope section in the notches.

8. The assembly of claim 1 wherein the binding sleeve forms a continuous covering about the product core.

9. A stretch-wrap packaged assembly comprising:

a product core having opposite ends;

a packing end cap of stiff material on each end of the product core;

each of the end caps having an end panel section and side flanges extending from the end panel section and defining a plurality of side corners of the respective cap;

stretched elastic film wrapped around the product core forming a binding sleeve extending between the end caps such that the film overlaps a first portion of the side flanges leaving a second portion of the side flanges uncovered by the film; and the binding sleeve having at least one terminal end edge created by a gathered portion of the film for forming a rope section for tightly circumscribing and engaging the side flanges of one of the end caps, the rope section being spaced inwardly of said product core from the horizontal centerline of said end cap such that the second portion of the side flanges is substantially free of coverage by the rope section.

10. The assembly of claim 9 wherein the side flanges of each of the end caps present structure defining V-shaped notches in the side corners for engaging the rope section in the notches.

11. A method of strength-wrapping a packaged assembly comprising the steps of:

forming a product core having opposite ends;

placing a packing end cap of stiff material on at least one end of the product core;

providing the end cap with an open end, an end panel section, and a plurality of side flanges extending from the end panel section thereby defining a plurality of side intersections of the end cap extending from the end panel section;

wrapping stretched elastic film around the product core to form a binding sleeve that extends between the end cap and the opposite end portion of the package such that the film overlaps a first portion of the side flanges leaving a second portion of the side flanges free of coverage by the film;

gathering at least one terminal end edge of the film to form a rope section;

tightly circumscribing and engaging the side flanges with the rope section in spaced relationship to the panel section and keeping the second portion of the side flanges substantially free of coverage by the rope section; and keeping the second portion of the side flanges free of coverage by the film.

12. The method of claim 11 further including the step of placing readable indicia on the second portion of the side flanges.

13. The method of claim 12 further including the step of forming the indicia as a machine-readable code.

14. The method of claim 13 further including the step of forming the indicia as an optically readable code.

15. The method of claim 11 further including the step of placing a label on the second portion of at least one of the side flanges.

16. The method of claim 15 further including the step of imprinting the labels with a machine-readable bar code.

17. The method of claim 11 further including the step of forming V-shaped notches in the side flanges at the side intersections for engaging the rope section in the notches.

18. The assembly of claim 11 further including the step of forming the binding sleeve as a continuous covering about the product core.

* * * * *